US012540480B2

(12) United States Patent
Nauwelaerts

(10) Patent No.: US 12,540,480 B2
(45) Date of Patent: Feb. 3, 2026

(54) WAVE MAKER

(71) Applicant: ALLWAVES B.V., Ostend (BE)

(72) Inventor: Steven Eddy Nauwelaerts, Ostend (BE)

(73) Assignee: ALLWAVES B.V., Ostend (BE)

( * ) Notice: Subject to any disclaimer, the term of this patent is extended or adjusted under 35 U.S.C. 154(b) by 88 days.

(21) Appl. No.: 18/555,159

(22) PCT Filed: Apr. 14, 2022

(86) PCT No.: PCT/IB2022/053516
§ 371 (c)(1),
(2) Date: Oct. 12, 2023

(87) PCT Pub. No.: WO2022/219575
PCT Pub. Date: Oct. 20, 2022

(65) Prior Publication Data

US 2024/0200349 A1 Jun. 20, 2024

(30) Foreign Application Priority Data

Apr. 15, 2021 (BE) ..... 2021/5298

(51) Int. Cl.
*E04H 4/00* (2006.01)

(52) U.S. Cl.
CPC ..... *E04H 4/0006* (2013.01)

(58) Field of Classification Search
CPC ..... E04H 4/0006
USPC ..... 4/488, 491, 541.1
See application file for complete search history.

(56) References Cited

U.S. PATENT DOCUMENTS

| | | | | |
|---|---|---|---|---|
| 4,812,077 | A * | 3/1989 | Raike | G01M 10/00 4/491 |
| 5,219,315 | A | 6/1993 | Fuller et al. | |
| 2008/0112820 | A1* | 5/2008 | Tormaschy | B01F 33/503 405/52 |
| 2010/0000014 | A1 | 1/2010 | Lochtefeld et al. | |
| 2012/0020735 | A1 | 1/2012 | Fricano | |
| 2014/0348588 | A1* | 11/2014 | Van Overloop | E02B 5/082 405/52 |
| 2022/0349198 | A1* | 11/2022 | Dascomb | E04H 4/0006 |
| 2022/0372780 | A1* | 11/2022 | Bennett | E04H 4/0006 |
| 2023/0056207 | A1* | 2/2023 | Bates | A63B 69/0093 |

FOREIGN PATENT DOCUMENTS

| | | | | |
|---|---|---|---|---|
| EP | 3329068 | B1 | 9/2019 | |
| WO | 2018/085681 | A1 | 5/2018 | |
| WO | 2020/097332 | A1 | 5/2020 | |
| WO | WO-2022178622 | A1 * | 9/2022 | E04H 4/0006 |
| WO | WO-2024082059 | A1 * | 4/2024 | E04H 4/0006 |

OTHER PUBLICATIONS

Applicant: Allwaves B.V., "Wave Maker"; International Application No. PCT/IB2022/053516; Filed: Apr. 14, 2022; PCT International Search Report dated Jul. 11, 2022; 2 ps.

* cited by examiner

*Primary Examiner* — Lori L Baker
(74) *Attorney, Agent, or Firm* — KDW Firm PLLC

(57) ABSTRACT

Device for making surfing waves, wherein the device has a chamber with an at least partially flexible upper wall which is anchorable at a predetermined depth below a water surface, wherein the device further comprises a plurality of actuators which are connected to the at least partially flexible upper wall in order to induce a wave motion in the at least partially flexible upper wall of the chamber.

13 Claims, 5 Drawing Sheets

WAVE MAKER

CROSS-REFERENCE TO RELATED APPLICATIONS

This application is a U.S. National Stage Application filed under 35 U.S.C. § 371 of PCT/IB2022/053516, filed Apr. 14, 2022, and entitled "WAVE MAKER", which claims priority from BELGIUM Patent Application No. 2021/5298, filed on Apr. 15, 2021. The entire contents of each of the above-identified patent applications are incorporated herein by reference.

The invention relates to a device for making surfing waves. The invention further relates to a pool comprising a device for making surfing waves and to a method for making surfing waves.

In a wave pool, such as a swimming pool with waves, waves can be created by generating water pressure locally. Such waves have however been found unsuitable for surfing on, since the wave properties desirable for this purpose cannot be easily achieved with existing methods.

Also known are wave simulators wherein, in order to form a wave, water is sprayed over a wave-shaped surface in order to generate a water flow over the surface. Surfers are however stationary here while the water flow passes underneath them, rather than the surfers moving along with the wave, as with wave surfing. A further drawback is that the wave shape is hardly adjustable in such simulators.

It is an object of the present invention to provide an improved wave maker.

For this purpose the invention provides a device according to appended claim 1. More specifically, a device is provided for making surfing waves, wherein the device has a chamber with an at least partially flexible upper wall which is anchorable at a predetermined depth below a water surface. The device further comprises a plurality of actuators which are connected to the at least partially flexible upper wall in order to induce a wave motion in the at least partially flexible upper wall of the chamber.

The invention is based on the insight that, when the flexible upper wall is anchored below a water surface, the wave motion of the flexible upper wall situated under water results in a surfing wave motion of the water surface. The upper wall is then preferably configured in rest to be substantially parallel to the water surface in rest. The upper wall is further preferably manufactured such that displacement of water through the upper wall during a wave motion is prevented. The upper wall can thus for instance be formed by a membrane, a plastic cloth or a tarpaulin. The flexible part of the upper wall particularly contributes to the ability to form the wave motion in the upper wall. The anchoring of the upper wall also contributes to the upper wall being kept in place.

The plurality of actuators enable a wave motion to be given a desired form, for instance in respect of wave length and/or wave height, for instance by the upward and downward movement of the flexible upper wall. The actuators can thus for instance be embodied by means of winches or crankshaft or camshafts, which can be placed on dry land or under water together with the flexible upper wall. Further examples of variants of the actuators can comprise racks and gears and other mechanisms which can bring about motion in parts of the upper wall. As a further alternative, hydraulic or pneumatic cylinders can be used as actuators. Combinations of the above are also possible.

The effect of the wave motion in the flexible upper wall on the surfing wave also depends on the depth at which the flexible upper wall is provided below the water surface. For this reason it could in some cases be preferable to place the upper wall for instance around 6 metres below the water surface. More generally, for wave surfing use it is preferable to have the flexible upper wall at least 2 m below the water surface at almost any moment during the wave motion so as to be able to guarantee safety for the surfer.

The construction with the flexible upper wall and the actuators whereby the wave motion can be imparted in the upper wall provides flexibility in respect of form, size and/or velocity of the wave motion. This flexibility allows a surfing wave to be created in accordance with a surfer's wishes. Tests and simulations have shown that such a device provides improved surfing waves and allows surfing waves for beginner surfers and surfing waves for experienced surfers, including so-called tube waves, to be created.

If the at least partially flexible upper wall has a length, i.e. if a dimension of the upper wall can be defined in a longitudinal direction, the plurality of actuators are preferably distributed over the length in order to allow the wave motion to advance in the longitudinal direction. A surfer can thus use a surfing wave induced in the longitudinal direction by the wave motion. An actuator can for instance follow the movement of a longitudinally adjacent actuator with some delay, whereby it appears as if the movement of the adjacent actuator has been transmitted in the longitudinal direction and a wave motion in the longitudinal direction can be brought about. The form of the wave motion in the longitudinal direction can thus be controlled by the actuators distributed over the length, for instance to form a wave motion which is sine-shaped along the longitudinal direction. The actuators are optionally disposed in a row parallel to the longitudinal direction, optionally along a central line of the flexible upper wall.

In addition, a determined wave length of the wave motion of the flexible upper wall has been found to result in two diverging water surfing waves as a result of the natural behaviours of the water. This is because, due to the behaviour of the water, the determined wave length of the wave motion is not always maintained in the distance between water surfing wave crests measured in the direction of the wave motion of the flexible upper wall. It is thus possible that this distance in this direction is smaller than the wave length of this wave motion. In that case the water behaves such that, in order to allow both an equal wave length in the water wave and an increasing distance in said direction between the crests, the water wave splits into two waves which diverge from the direction of the wave motion in the flexible upper wall. In this way a single induced wave motion in the flexible upper wall can ultimately provide for two diverging surfing waves which are each located on one side of the device and which can each be used by a surfer simultaneously, so two surfers in all.

The plurality of actuators are then more preferably distributed over the length of the upper wall with a maximum intermediate distance in the longitudinal direction. The object of the maximum intermediate distance is to make it possible to form a controllable wave motion. In other words, without maximum intermediate distance the form of the wave motion in the part of the flexible upper wall between the actuators depends largely on the natural behaviours of the flexible upper wall, and the wave motion and thereby the surfing wave to be formed is adjustable to lesser extent. For a typical wave length of 24 metres at least one actuator is preferably utilized for every 6 metres, i.e. 4 actuators per 24 metres, to be able to simultaneously define both the wave crest and the wave trough in combination with two intermediate wave parts of the wave motion. The maximum distance can generally amount to a maximum of 6 metres, preferably a maximum of 4 metres, more preferably a maximum of 2 metres, most preferably a maximum of 1 metre. More generally, it can be noted that a higher resolution of actuators, i.e. smaller mutual distances of the actuators, results in a wave motion which can be controlled better.

According to a further embodiment of the invention, the length of the flexible upper wall is at least 30 metres, preferably at least 50 metres, more preferably at least 70 metres. The longer the flexible upper wall, the longer the wave motions which can be induced thereby and the longer an induced wave motion can be maintained over the length of the flexible upper wall. It is noted here that the length of the partially flexible upper wall is preferably a plurality of the wave length of the wave motion. If this is not the case, it may occur that the wave motion, formed by for instance upward and downward movements, has over the length of the flexible upper wall an average deviation from the state of equilibrium due to the sum of these movements, which is preferably prevented. A longer flexible upper wall therefore has the additional advantage that a plurality of wave lengths become possible, these meeting the preference that the length of the upper wall is a multiple of the wave length of the wave motion.

According to a further embodiment, the at least partially flexible upper wall has a width of at least 4 metres, preferably at least 7 metres, more preferably at least 10 metres. The above stated minimum widths and lengths would in use enable simulation of water waves with a width, length and/or duration desirable for surfing.

The plurality of actuators are preferably placed at the position of the side edge, preferably at the position of opposite side edges of the at least partially flexible upper wall, in a width direction. Such a placing of the actuators enables the actuators to move the flexible upper wall in balanced manner over the width thereof. Unevennesses in the width direction, such as convexity, which may impede a harmonious wave motion in the longitudinal direction, are thus prevented. Actuators placed on either side are in that case preferably adapted to each other for co-action. Such a placing of the actuators further provides for a lever action on the flexible upper wall. More specifically, the actuators can induce a considerably greater displacement of the flexible upper wall with a limited stroke. An intended displacement of the flexible upper wall and an intended speed of pulling in and paying out can hereby be achieved with actuators available as standard. A zone of the upper wall lying between the opposite side edges is more preferably free of actuators. The plurality of actuators are thus placed only at the position of the opposite side edges. This is understood to mean that no further actuators are arranged in a space between the two opposite side edges. This intermediate zone is therefore free of actuators. The upper wall between the position where most actuators are mounted on either side is in this way free to move in a displacement direction, so that the above stated great displacement of the flexible upper wall is optimally inducible. This displacement has a mutual ratio to the stroke of the plurality of actuators. This is because the displacement is induced by pulling or paying out on either side of the upper wall. By pulling or paying out on either side the displacement is considerably greater than the stroke of each of the plurality of actuators.

The chamber preferably further defines a substantially wholly closed volume so that a downward movement of the at least partially flexible upper wall at a first location causes an upward movement of the at least partially flexible upper wall at a second location. In one embodiment the chamber is defined by a closed, preferably elongate bag or bellows, of which the flexible upper wall forms part. For further elucidation reference is made to the principle of communicating vessels or the waterbed effect, wherein a compression at one location brings about a convexity at another location. The chamber can be filled with a fluid and/or gas. In one embodiment the chamber is filled with air. An advantage of air in the chamber is that the resistance against displacement of the air inside the chamber, for instance as a result of inertia, is minimal. An advantage of water in the chamber is that any minimal leaks have little negative impact, and that the limited compressibility of water allows for a movement of the flexible upper wall which can be controlled well.

Building on the above it is noted that it is preferred, particularly in the case of a closed chamber, that to enable effective formation of the intended wave motion the length of the operational flexible upper wall is a multiple of the set wave length. This ensures that for every wave motion the local volume increase in the chamber, as a result of upward movement of the wave motion, is in equilibrium with the corresponding local volume decrease in the chamber as a result of the downward movement of the wave motion. The intended object is to keep the total volume in the chamber substantially constant. Such volume changes thus have the characteristics of a waterbed.

The actuators can be provided to realize an upward or downward movement by pushing or pulling the at least partially flexible upper wall upward or downward and to pay out the at least partially flexible upper wall in order to allow an opposite downward or upward movement. It is possible that an overpressure is maintained in said chamber in order to thrust the flexible upper wall upward in order to enhance inducing of the wave motion as a result of the pressure difference on either side of the flexible upper wall. An underpressure could also be maintained in the chamber in order to achieve the same effect. An underpressure in the chamber however entails that when a crack occurs in the upper wall, a surfer will be sucked into the chamber through the crack as a result of the underpressure. An overpressure is therefore preferably maintained in the chamber in order to guarantee safe use of the device.

It is then specifically preferred for the actuators to be provided to realize a downward movement by pulling the at least partially flexible upper wall downward. The pulling downward generates a pressure in the chamber which induces an upward movement at a different location by paying out or releasing the actuators. The actuators can for instance be placed under the flexible upper wall, optionally in the chamber, whereby a compact device is obtained. The actuators can thereby also anchor the flexible upper wall. As with the waterbed effect, an upward movement elsewhere in the flexible upper wall can be brought about by the pulling downward.

It is then likewise preferred for the actuators to be provided to pay out the at least partially flexible upper wall in order to allow an upward movement. A further advantage of the closed chamber is in that case that for the reciprocal movement an actuator need induce active movement for only one direction and, owing to active movement in the same direction by a counteracting actuator further along, need allow only passive movement in opposite direction. In other words, the relevant actuator need thus only be activated in the case of a downward movement resulting from the pulling, and can co-displace passively with the flexible upper wall during a subsequent upward movement. This contributes to an efficient use of the actuators.

The at least partially flexible upper wall preferably comprises a film over which strengthening straps are provided at least in the transverse direction and at least at the position of the plurality of actuators. The film contributes inter alia to the flexibility of the upper wall. Since a relatively great force is exerted by the actuators on the flexible upper wall at the position of the actuators, the strengthening straps are preferably provided precisely there in order to prevent damage to the flexible upper wall and thereby extend the lifespan of the device and/or reduce maintenance costs. It is therefore further preferred in that case that a plurality of actuators each engage on the film and the strengthening strap.

The at least partially flexible upper wall is preferably connected to at least one air bag which is provided to exert an upward force on the at least partially flexible upper wall. When the flexible upper wall is connected to one or more air bags, an alternative embodiment can be provided. This is because the air bag will exert upward force on the upper wall under water. When an actuator is payed out, the flexible upper wall will hereby be pulled upward by the air bag. It is therefore not essential to make the chamber as a closed volume, nor to generate an overpressure in the chamber. The air bag can however also be an advantage when the chamber forms a closed volume. In such an embodiment the air bag can generate an additional upward force. The air bag can also keep the chamber in a preferred form, without considerable external force, when the device is not in use.

According to a further embodiment of the device, the plurality of actuators take the form of hydraulic cylinders whereby an actuator can bring about a linear movement in effective manner. The hydraulic cylinders can for this purpose have for instance a telescopic form. The cylinders can likewise be both single-acting and double-acting. If the hydraulic cylinders are configured under the flexible upper wall, they are able to make a part of the flexible upper wall move downward by means of a retracting movement. It is preferred here for cylinders placed on either side of the upper wall to be directed at least partially toward each other and at least partially upward, whereby the pulling downward of the flexible upper wall also brings about pulling tight thereof in order to obtain a lever action and have the flexible upper wall perform a greater movement than the stroke of the cylinders. The cylinders are then preferably disposed, as seen from the upper wall, directed away from each other in the transverse direction of the upper wall. In other words, the cylinders are preferably disposed leaning toward each other in the direction of the flexible upper wall.

According to a further embodiment of the device, a pump is provided to bring a content of the chamber to a predetermined pressure. With this pump the above described overpressure can be created when the device is started up, for instance when the device is switched off occasionally due to periodic use. The pump can furthermore contribute to keeping the chamber at pressure when the device is in use. Both air and water, or any fluid whatsoever, can otherwise be pumped into the chamber in order to create the pressure therein.

The device can be placed in different types of water body, such as in a lake or a canal, or any other pool. The invention therefore also relates to a pool comprising a device according to any one of the foregoing embodiments. The pool is preferably filled at least partially with water. The flexible upper wall of the device is preferably anchored at the predetermined depth below the water surface.

The pool preferably comprises a pool bottom between the device and a peripheral edge of the pool which has a decreasing depth from the device toward the peripheral edge. The decreasing depth has the result that water waves from the device can increase in height and can break toward the peripheral edge. It is inter alia such a development of the water wave that makes it suitable for surfing.

The device is preferably configured in a central zone of the pool to enable wave motions and/or a pool bottom decreasing in depth in multiple directions, as seen from the device. It is then particularly preferred for at least one half of the pool, preferably both halves, to be substantially rectangular. The space required for the pool can thus be utilized efficiently by configuring the device such that water waves advance toward the corners of the pool and thereby enable surfing over a relatively long distance. For this purpose the pool preferably further has a substantially plane-symmetrical form.

It is further preferred for the pool bottom to comprise a trench which preferably extends between the device and two corners of the at least one half. The trench creates space for water to flow over the pool bottom from the corners and from the peripheral wall toward the device. This prevents the water close to the pool bottom, particularly the water flowing therealong, from influencing the surfing waves at the water surface. The trench preferably lies in line with the longitudinal direction, i.e. the direction of the wave motion, of the flexible upper wall.

A further embodiment of the pool has a pool length and a pool width. In other words, dimensions of the pool can be defined in a longitudinal direction and in a width. The pool length is preferably at least 20 metres greater than the length of the device, more preferably at least 40, and is preferably a maximum of 150 metres greater than the length of the device, more preferably a maximum of 120 metres. Tests and simulations have shown that it is particularly when the pool length is too small in relation to the length of the device that the surfing wave formation is adversely affected. The pool width is preferably at least 20 percent greater than a width of the flexible upper wall of the device, preferably at least 30 percent, more preferably at least 40 percent and/or the pool width preferably amounts to a maximum of 1000 percent of the width of the flexible upper wall of the device, preferably a maximum of 900 percent, more preferably a maximum of 800%. It can more generally be noted that the greater the pool relative to the flexible upper wall, the greater the portion of the pool over which surfing can take place between the device and the peripheral edge.

According to a further aspect of the invention, it further relates to a method for making surfing waves, comprising the step of inducing a wave motion in an at least partially flexible wall, preferably at a predetermined depth below a water surface. The invention is based on the insight that the wave motion results in a surfing wave motion in the water surface which is suitable for surfing.

The wave motion preferably comprises a wave pattern with at least one crest and at least one trough. The step of inducing the wave motion in that case preferably comprises of advancing the wave pattern in a first direction. The wave pattern is for instance sine-shaped and is then preferably advanced in the longitudinal direction of the flexible wall.

The method further preferably comprises of pulling the at least partially flexible wall downward, preferably at the position of the at least one trough in order to be able to bring about the trough at that position.

The method further preferably comprises of paying out or pushing upward the at least partially flexible wall, preferably at the position of the at least one crest in order to be able to bring about the crest at that position.

The wave pattern preferably comprises a whole number of wave pattern segments at almost every moment during the advancement of the wave motion. If this is not the case, it may occur that the wave motion, formed by the one or more crests and troughs, has over the length of the flexible upper wall an average deviation from the state of equilibrium, which is preferably prevented. In other words, forming the wave pattern such that it has a whole number of wave pattern segments at almost every moment ensures that the volume under the flexible wall is substantially constant. It is noted here that the whole number of wave pattern segments does not preclude the flexible upper wall from comprising a neutral segment, for instance at a longitudinal end.

If the flexible wall forms a flexible upper wall of a chamber, the method preferably further comprises the step of bringing a content of the chamber to a predetermined pressure, preferably prior to the step of inducing the wave motion. The predetermined pressure can hereby be maintained in the chamber in order to thrust the flexible upper wall upward in order to enhance the induction of the wave motion as a result of the pressure difference on either side of the flexible upper wall. This pressure can for instance be created when the device is started up, for instance in order to enable the device to be switched on and off occasionally during periodic use. The chamber can furthermore be kept at pressure when the device is in use.

The invention will now be further described on the basis of exemplary embodiments shown in the drawings.

Figure 5A:
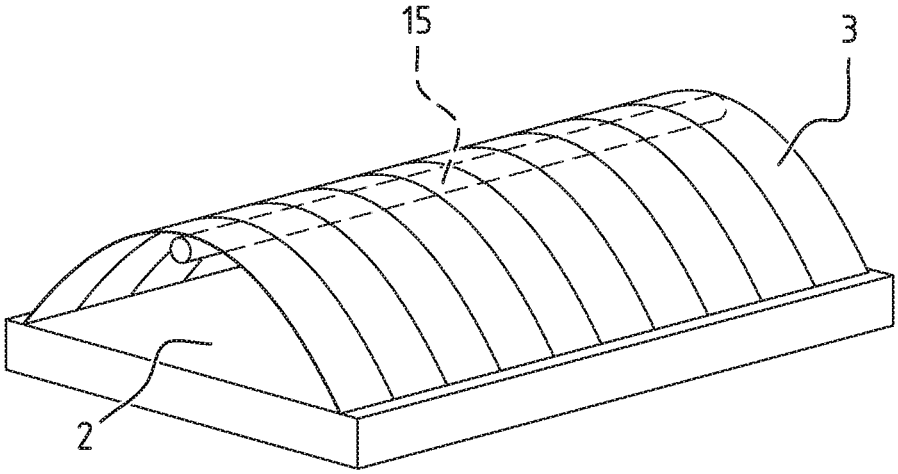
Figure 5B:
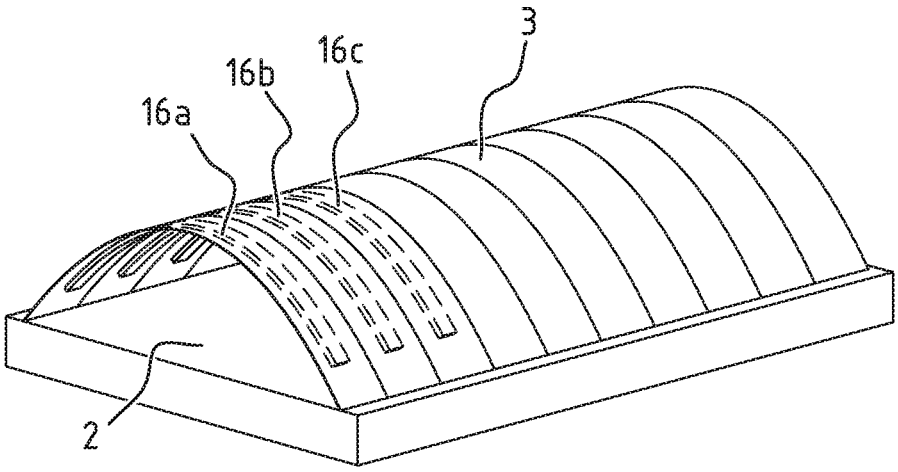

FIGS. 5*a* and 5*b* show several perspective views of further embodiments of the invention.

The same or similar elements are designated in the drawings with the same reference numerals.

Although the invention was developed and is intended for making surfing waves, it will be apparent that the range of applications can be wider in practice. A similar device can also be constructed in for instance a water park in order to increase the options for generating different wave types and sizes. Although little actual surfing may take place in such a context on the surfing waves formed in this way, the device will still comply with and thereby by covered by the features of claim 1.

Figure 1:
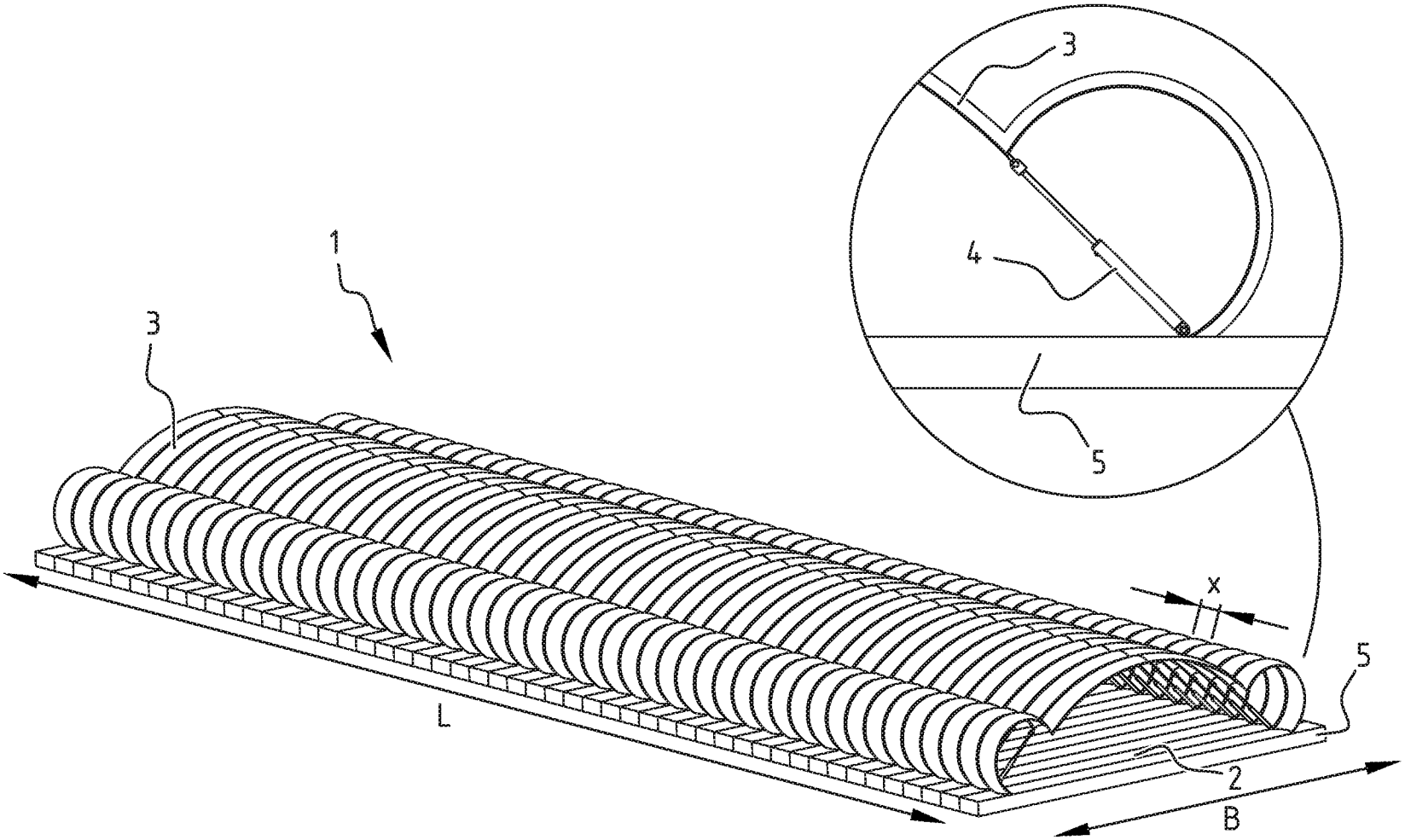
FIG. 1 shows a perspective view of an embodiment of the device.

FIG. 1 shows the device 1 with a chamber 2 with an at least partially flexible upper wall 3. Device 1 further comprises a plurality of actuators 4 which are connected to the at least partially flexible upper wall 3 in order to induce a wave motion in the at least partially flexible upper wall of the chamber, as shown in for instance FIG. 2. FIG. 1 shows only a part of chamber 2 because the chamber 2 is in practice closed on a front side and on a rear side according to an embodiment. The content of the chamber is hereby preferably predetermined and substantially constant. This embodiment is described below and shown in FIG. 2. In an alternative embodiment the chamber is open, as shown in FIG. 1. This alternative embodiment is also described below and shown in FIGS. 5*a* and 5*b*.

The underside of chamber 2 is formed in the embodiment of FIG. 1 by a foundation plate which functions as anchoring 5 of the chamber. It will be elucidated below that this construction is just one embodiment. In the shown embodiment the foundation plate forms the underside of chamber 2. Provided above foundation plate 5 is a flexible upper wall 3. The flexible upper wall 3 has a length L and a width B. The length L is preferably greater than 50 metres, more preferably greater than 70 metres. The width B is preferably greater than 5 metres, more preferably greater than 10 metres, more preferably greater than 15 metres, most preferably greater than 20 metres. In the shown embodiment the transverse edges of flexible upper wall 3, these being the edges lying substantially parallel to the longitudinal direction, are connected fixedly to the foundation plate so as to form the chamber 2 between the foundation plate on one side and the flexible upper wall 3 on the other. The flexible upper wall 3 extends over a length along a longitudinal axis. The device is preferably constructed substantially symmetrically around an upward plane of symmetry which comprises the longitudinal axis. A plurality of actuators is provided, distributed at substantially equal intermediate distances relative to each other in the longitudinal direction, between flexible upper wall 3 and foundation 5. Each actuator is provided to induce at least an upward and/or downward movement of a portion of the flexible upper wall 3. In other words, the flexible upper wall 3 is theoretically and/or physically sub-divided into a plurality of segments, wherein each segment is provided with one or more actuators. The actuators can control the height of the relevant segment. By controlling different segments at different heights with the relevant actuators a height profile can be created in upper wall 3. A sine-shaped height profile can thus for instance be created in the longitudinal direction of upper wall 3. By moving the actuators the formed height profile can be shifted in the longitudinal direction. The height profile is deemed a standing wave during standstill. By shifting the height profile a wave with a wave velocity is created. Such a wave with a wave velocity in the flexible upper wall 3 is referred to in this text as a wave motion.

The skilled person will appreciate that the upper wall can also be constructed by a chain of hard segments. When these hard segments can each be height-controlled separately of each other, the whole can still be deemed flexible because a movement which appears organic can be created. Although the individual segments may not be flexible, the whole does have a flexibility owing to the plurality of individual segments placed one behind the other, so that the whole upper wall can still be deemed flexible in such an embodiment. The material of which the upper wall consists is preferably flexible so that the upper wall can be moved.

In the embodiment shown in FIG. 1 the actuators 4 are placed on an inner side of chamber 2. Actuators 4 are provided to pull a central portion of upper wall 3 downward. A side portion of the upper wall is here formed around the actuators. In order not to impede the actuators when retracting and paying out the central portion of the upper wall the length of the side portion of the upper wall is greater, as seen in the transverse direction, than the actuator in its most extended state so that the side portion has a convexity over the actuators. This convexity is clearly visible in the figure. The convexity is also a result of an overpressure which is created in chamber 2, which overpressure ensures that the flexible upper wall, including the central portion and the two side portions, expand upward and/or outward.

Preferably provided are strengthening straps which are connected to upper wall 3 between opposite actuators 4. The strengthening straps preferably extend over at least the central portion of the upper wall. Upper wall 3 can be manufactured from a plastic film, rubber film, EPDM, woven fabric, other flexible flat material or a combination or composition thereof.

The figure shows a device which is formed substantially symmetrically around a plane comprising the longitudinal axis. Actuators are hereby provided on either side of the central portion of the upper wall. This provides for a good and balanced movement of the flexible upper surface. It will however be apparent to the skilled person that an alternative configuration can be provided wherein the actuators are provided on one side. As further alternative, actuators can be distributed asymmetrically over the one and the other side in a repetitive pattern or a random pattern.

The figure shows a device wherein actuators are provided under water. The actuators can then for instance be maritime hydraulic cylinders. Other drives usable under water can also be applied. The movement of the flexible upper wall can alternatively be transmitted to a location above water via cables or straps and one or more pulleys or other guides. Actuators can then be provided at this location. These actuators can be selected from hydraulic, electric, pneumatic or mechanical actuators. An example of a mechanical actuator is a camshaft driven by a combustion engine. Such a camshaft can be configured with cams and a crankshaft which are placed such that corresponding straps are tightened, wherein the camshaft is formed to induce a wave motion in the flexible upper wall.

Figure 2:
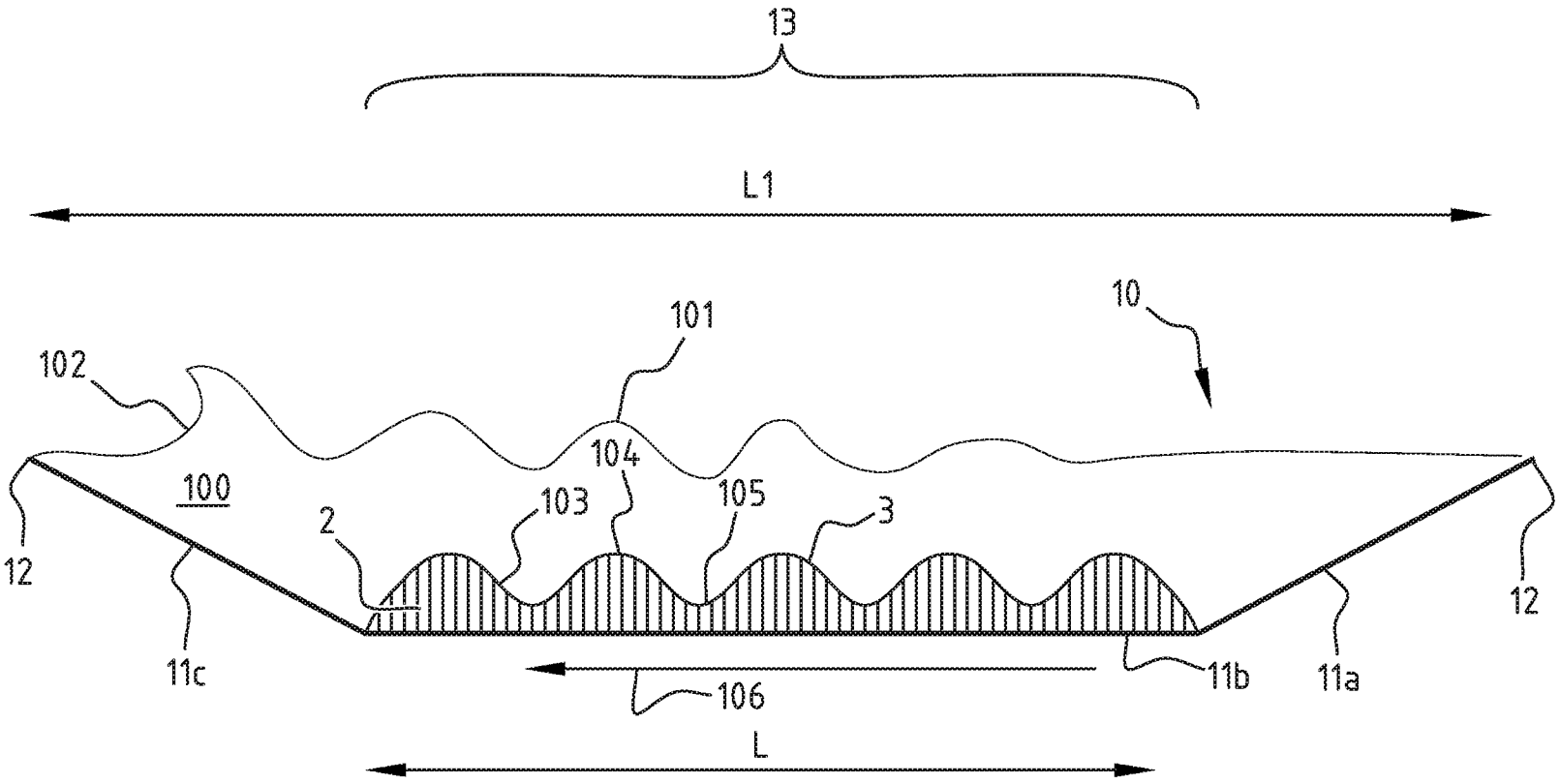
FIG. 2 shows a longitudinal section of a pool with a device according to an embodiment of the invention.

FIG. 2 shows a longitudinal section of a device which is placed in a pool 10. The pool can take the form of a large swimming pool or swimming pond. The pool has dimensions, more specifically a length and width, which are considerably greater than the dimensions of the flexible upper wall 3. A distance is hereby created between the edges of the pool, these being the front pool edge, rear pool edge and the two pool sides, and the edges of the flexible upper wall 3. This distance is used to have a bottom of the pool bridge a depth difference between an edge depth which is typically limited and a depth at which flexible upper wall 3 is placed. This is designated in FIG. 2 with reference numerals 11*a* and 11*c*, which are referred to as rising banks of the pool.

In the embodiment of FIG. 2 not only the transverse edges of the flexible upper wall 3 are connected to the foundation, but the edges at the position of the two longitudinal ends are also connected to the foundation. This creates a chamber with a substantially constant volume between the foundation and the flexible upper wall. Owing to the constant volume, a waterbed effect is achieved, wherein pulling the flexible upper wall downward at one location results in a proportional rise of the flexible upper wall at another. This can be controlled by tightening and paying out actuators. In this embodiment a pump can additionally be provided in order to create a slight overpressure in the chamber so that the flexible upper wall tends to have an inflated appearance in unloaded state due to the overpressure. According to one embodiment the flexible upper wall 3 is preferably placed at least 2 metres, preferably at least 3 metres and a maximum of 8 metres, preferably a maximum of 6 metres, more preferably a maximum of 5 metres below the water surface. This is based on the water surface of the pool in standstill and the flexible upper wall also in an unloaded or average state.

FIG. 2 illustrates that a wave pattern can be imparted to the upper flexible wall 3 of chamber 2. This wave pattern 103 typically has a plurality of crests 104 and a plurality of troughs 105. Wave pattern 103 is chosen such that the number of crests 104 is equal to the number of troughs 105 in order to keep a total volume in chamber 2 substantially constant. The skilled person will appreciate that the actuators 4 of FIG. 1 can be controlled to create such a wave pattern 103 in the flexible upper wall 3. In other words, each wave pattern has a plurality of wave pattern segments. A wave pattern segment has one crest and one trough. The plurality of wave pattern segments can be identical or can have different forms in order to induce a predetermined effect on the water surface. The whole wave pattern is preferably constructed from a whole number of wave pattern segments in order to keep the total volume content of chamber 2 substantially constant. The wave pattern moves in the longitudinal direction of the device at a wave velocity 106 in order to create a wave motion in the flexible upper wall 3.

The wave motion in flexible upper wall 3 propagates through the water in the pool and forms a water wave on the water surface 102. Directly above the device the water wave typically has a period and a frequency which are substantially equal to the period and frequency of the wave motion. Due to the rising banks 11*a* and 11*c* the water wave moving toward the edge of the pool is pushed upward and breaks so as to form a surfing wave 102. This will be further elucidated with reference to FIG. 3.

Figure 3:
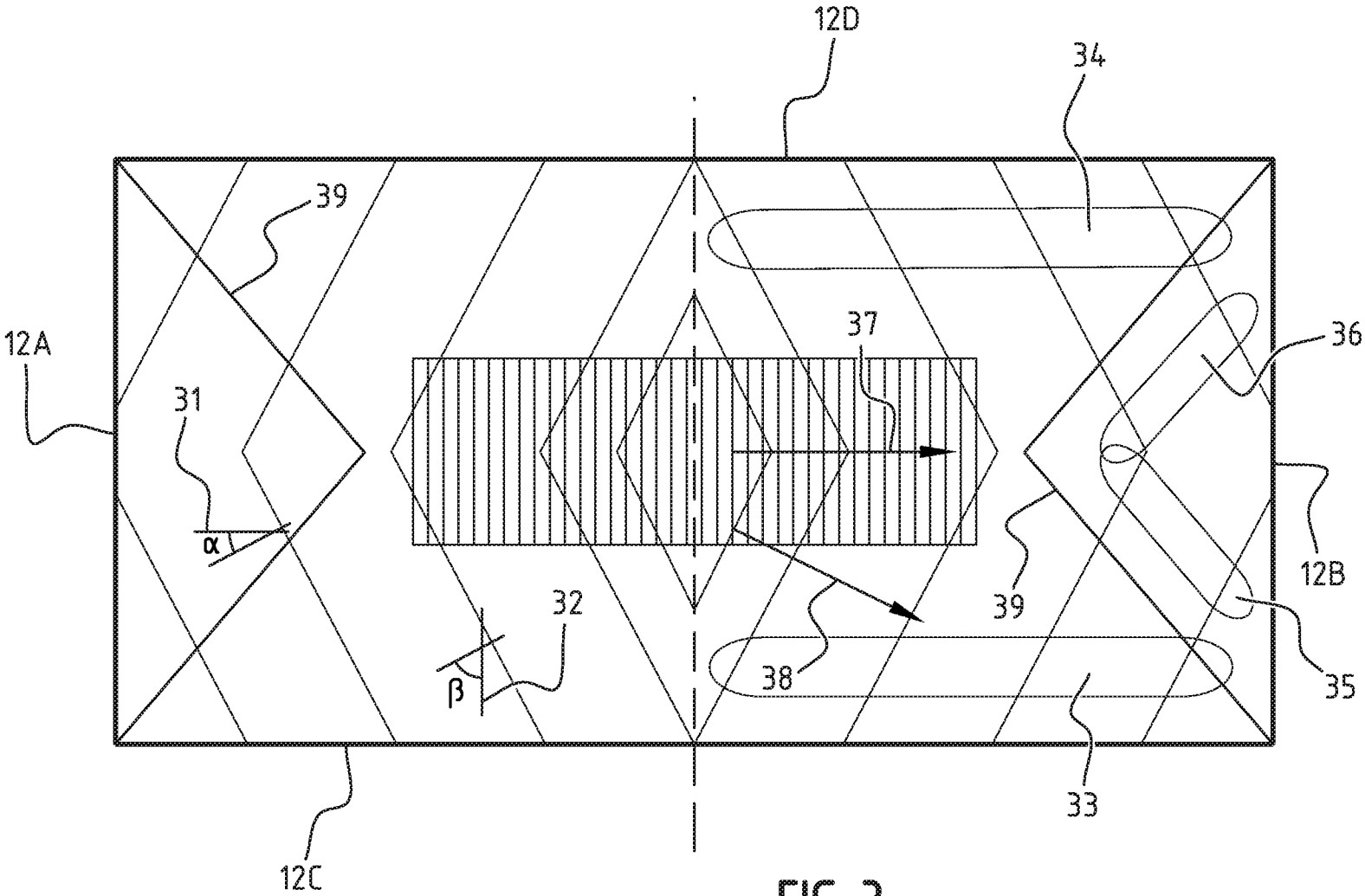
FIG. 3 shows a top view of the pool with device according to the invention.

FIG. 3 shows a top view of a pool 10 with a device 1 according to a preferred embodiment of the invention. Pool 10 has four edges, two end edges 12A and 12B and two side edges 12C and 12D. Formed at the position of the edges are rising banks, wherein a rising direction shown by line 31 for the end edges and line 32 for the side edges. In the shown embodiment the device 1 is used in two parts. This means that one half of the device generates a wave motion toward a first end side, while a second half of the device generates a wave motion toward a second end side of the pool. It will be apparent that this is just one possible use of the device. The device can also be switched completely to one direction in order to form one wave motion toward one of the end sides and so form a surfing zone with a maximum length.

FIG. 3 also shows a further particular effect of the use of a device according to an embodiment of the invention in a pool. More specifically, FIG. 3 shows that water waves form an angle $\alpha$ with the wave motion. This behaviour can be elicited by selecting a period and frequency of the wave motion in flexible upper wall 3. The result is that a water wave in each case reaches the rising bank at an angle. At the position of the end edges of the pool this is the angle $\alpha$. At the position of the side edges of the pool this is the angle $\beta$. Tests and simulations have shown that this angle is highly advantageous in the formation of a surfing wave. In the configuration as shown in FIG. 3, wherein the device generates two different wave motions, one toward the first end edge and a second toward the second end edge, eight surfing zones are formed. A first and a second surfing zone, designated in FIG. 3 with reference numerals 33 and 34, result along the side edge for each wave motion. Two surfing zones, designated in FIG. 3 with reference numerals 35 and 36, are also formed at the position of the end edge. Each surfing zone results mainly in that the water wave runs at an angle to, i.e. not parallel to, the edge. These angles are designated with a and $\beta$. In the figure the angles are drawn on the left and the surfing zones are drawn on the right. The skilled person will appreciate that surfing zones can also be formed on the left and that these angles are also relevant on the right. In order not to make the drawing unnecessarily complex not all aspects have been designated everywhere.

Referring to FIG. 3, emphasis is once again placed on the phenomenon that the wave motion extends in a direction 37 while the water wave extends in a direction 38. This is a natural phenomenon. This is because water has a preferred eigenfrequency for waves with a determined period. By taking this into consideration when forming the wave motion in the flexible upper wall a deflection of the water wave from the wave motion direction can be induced. In FIG. 3 lines 39 indicate locations where the rising banks meet. Preferably formed at the position of these lines 39 are trenches with a predetermined width and with a depth greater than the adjacent bank. A channel is hereby obtained along which the water can flow back to a deeper part of the pool. This is because the waves push the water toward the edges of the pool. The water can run back via the trenches 39. An undercurrent at the position of the banks is thus reduced.

FIG. 4 shows a plurality of possible cross-sections of a device according to an embodiment of the invention. FIG. 4A shows here the preferred embodiment already discussed at length above. More specifically, FIG. 4A shows an embodiment wherein a flexible upper wall is formed as an arch on a foundation 5. By tightening the actuators the relevant segment of the flexible upper wall is pulled downward in order to form a trough in the wave motion. Paying out the actuators will move the flexible upper wall outward as a result of an overpressure in chamber 2 in order to form a crest in the wave motion.

Figure 4A:
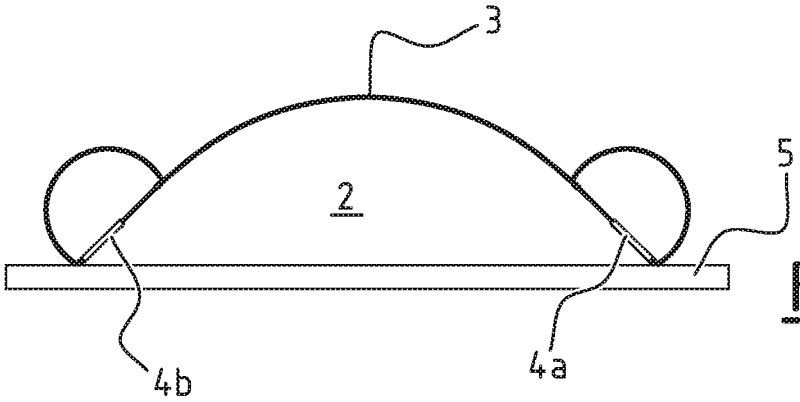
FIG. 4 show several cross-sections of different embodiments of the invention.
Figure 4B:
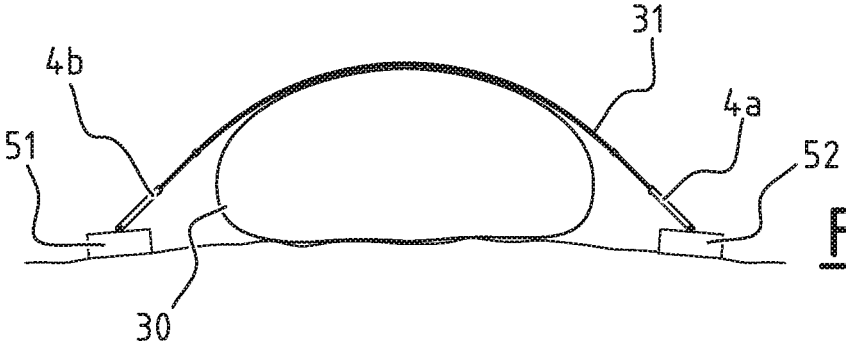

FIG. 4B shows an alternative embodiment which operates on the basis of the same principle. In the embodiment of FIG. 4B the flexible upper wall is formed as an integral part of a bag or sleeve, designated with reference numeral 30. The bag or sleeve 30 can be filled with water or air or another fluid, and be placed on a central the bottom of a pool. Actuators 4*a* and 4*b* are provided on either side and are connected to each other by means of cords, straps or winches 31, wherein the chords, straps or winches 31 are placed over the bag or sleeve 30. Similarly as in the embodiment of FIG. 4A, tightening of the actuators 4*a* and 4*b* will provide for a trough in the wave motion while paying out the actuators will provide for a crest in the wave motion. The actuators 4*a* and 4*b* are preferably provided with a respective foundation 51 and 52. The bag or sleeve 30 can be placed on a bottom of the pool. The foundation can alternatively (not shown) continue under the bag or sleeve 30 from the one actuator 4*a* to the second actuator 4*b*.

Figure 4C:
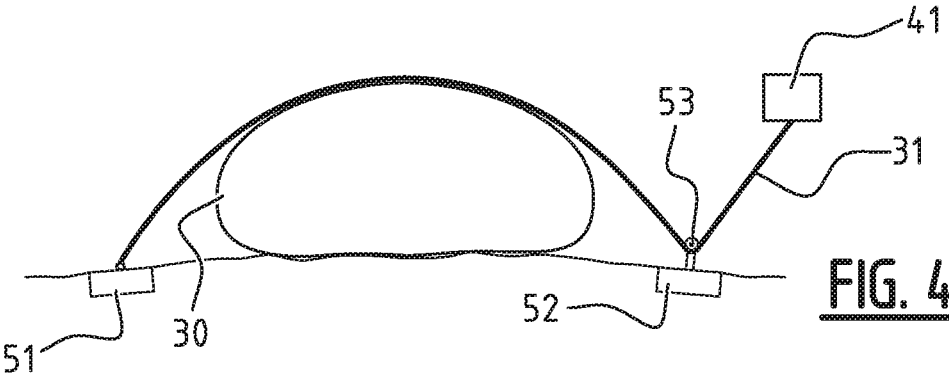

FIG. 4C shows a further alternative embodiment wherein a cord, strap or winch 31 is used to transfer the movement to a bank of the pool. The cord, strap or winch 31 is there tightened or payed out by means of system 41. A pulley 53 is provided on a foundation 52 in order to transfer the movement of the cord, strap or winch 31 to the bag or sleeve 30.

Figure 4D:
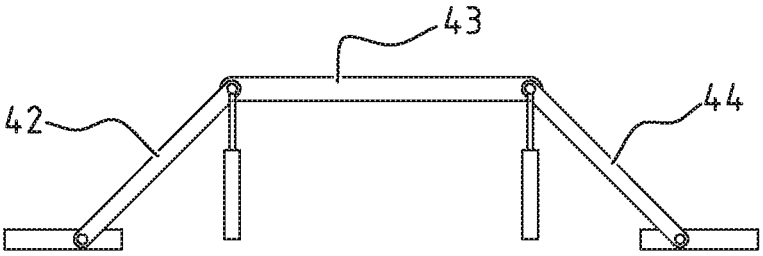

FIG. 4D shows a further alternative embodiment wherein substantially solid or rigid plates 42, 43 and 44 are connected to each other by means of hinges and wherein the plates 42, 43 and 44 can be pushed upward and downward by means of actuators. By placing a plurality of such segments one behind the other a whole can be formed wherein the different segments can move independently of each other and so create an organic movement in the water. More specifically, the upper wall of such a construction can make a wave motion so that the upper wall can be deemed flexible.

FIGS. 4A, 4B, 4C, 4D further show that the upper wall has a free zone. The free zone is the zone which lies between the opposite side edges and is free of actuators. This is understood to mean that no actuators are connected to the upper wall in the free zone between the two opposite side edges. The intermediate zone is therefore free of actuators. In this way the upper wall is free to move in a displacement direction so that the great displacement of the flexible upper wall can be induced optimally. This is because the displacement is induced by pulling or paying out on both sides of the upper wall. By simultaneously pulling or paying out on both sides the displacement is considerably greater than the stroke of each of the plurality of actuators. In this way the displacement is also proportional to the stroke.

FIGS. 5*a* and 5*b* show two embodiments wherein the chamber 2 can be open, i.e. at least one edge at the position of at least one of the two longitudinal ends is not connected to the foundation. As a further option, the transverse ends can even be at least partially open, i.e. not connected to the foundation over the whole length. In this embodiment the upward force is generated by at least one air bag which is positioned under and/or is connected to the flexible upper wall 3. In the embodiment of FIG. 5*a* an air bag 15 is embodied as a tube extending in the longitudinal direction, over substantially the whole length of flexible upper wall 3. In the embodiment of FIG. 5*b* a plurality of air bags 16*a*, 16*b*, 16*c* are placed as tubes transversely under flexible upper wall 3. In the latter embodiment it is advantageous for the air bags to have an intermediate distance which corresponds roughly to the intermediate distance between actuators. Adjacent actuators define here an upper wall section, and an air bag is provided in each upper wall section. Air bags can be formed as separate elements and be placed loose under the flexible upper wall. Air bags can alternatively be integrated in the flexible upper wall, wherein an air pump system is provided to fill the air bags and keep them at pressure. As further alternative, air bags can be provided as separate elements and be connected to the flexible upper wall, for instance by providing so-called pockets in or on the flexible upper wall. The skilled person will appreciate that combinations of the embodiments shown in FIGS. 5*a* and 5*b* are also possible. FIGS. 5*a* and 5*b* show no actuators because the skilled person will appreciate that each embodiment shown in FIGS. 4*a*-4*d* is applicable. It is further noted that the embodiment with the air bags 15, 16 can also be combined with the embodiment shown in FIG. 2, wherein the chamber is closed.

The skilled person will appreciate on the basis of the above description that the invention can be embodied in different ways and on the basis of different principles. The invention is not limited here to the above described embodiments. The above described embodiments and the figures are purely illustrative and serve only to increase understanding of the invention. The invention will not therefore be limited to the embodiments described herein, but is defined in the claims.

The invention claimed is:

1. A Device for making surfing waves, the device comprising:

a chamber with an at least partially flexible upper wall configured to be anchored at a predetermined depth below a water surface; and a plurality of actuators connected to each side edge of the at least partially flexible upper wall in order to induce a wave motion in the at least partially flexible upper wall of the chamber, wherein the plurality of actuators are tangentially connected to each side edge of the least partially flexible upper wall such that by pulling or paying out on either side of the least partially flexible upper wall induces a displacement in the least partially flexible upper wall which is greater than a stroke of each of the plurality of actuators.

2. The device according to claim 1, wherein the at least partially flexible upper wall has a length and wherein the plurality of actuators are distributed over the length and with a maximum intermediate distance in the longitudinal direction in order to allow the wave motion to advance in the longitudinal direction.

3. The device according to claim 2, wherein the maximum distance is a maximum of 6 metres.

4. The device according to claim 2, wherein the length is at least 30 metres.

5. The device according claim 2, wherein the at least partially flexible upper wall has a width of at least 4 metres.

6. The device according to claim 1, wherein a zone of the upper wall lying between the opposite side edges is free of actuators.

7. The device according to claim 1, wherein the chamber defines a substantially wholly closed volume so that a downward movement of the at least partially flexible upper wall at a first location causes an upward movement of the at least partially flexible upper wall at a second location.

8. The device according to claim 1, wherein the actuators are configured to realize a downward movement by pulling the at least partially flexible upper wall downward.

9. The device according to claim 8, wherein the actuators are configured to pay out the at least partially flexible upper wall in order to allow an upward movement.

10. The device according to claim 1, wherein the at least partially flexible upper wall comprises a film over which strengthening straps are provided at least in a transverse direction and at least at the position of the plurality of actuators, and wherein the plurality of actuators each engage on the film and the strengthening strap.

11. The device according to claim 1, wherein the at least partially flexible upper wall is connected to at least one air bag which is configured to exert an upward force on the at least partially flexible upper wall.

12. The device according to claim 1, wherein the plurality of actuators comprise hydraulic cylinders.

13. The device according to claim 1, further comprising a pump configured to bring a content of the chamber to a predetermined pressure.

* * * * *